US007101188B1

(12) United States Patent
Summers et al.

(10) Patent No.: US 7,101,188 B1
(45) Date of Patent: Sep. 5, 2006

(54) ELECTRICAL EDGE CONNECTOR ADAPTOR

(75) Inventors: Mark D. Summers, Phoenix, AZ (US); Lawson Guthrie, Portland, OR (US); William Handley, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 11/094,872

(22) Filed: Mar. 30, 2005

(51) Int. Cl.
*H01R 12/00* (2006.01)

(52) U.S. Cl. ..... 439/59; 439/945; 439/638

(58) Field of Classification Search ..... 439/945, 439/59, 638
See application file for complete search history.

(56) References Cited

U.S. PATENT DOCUMENTS 5,679,007 A * 10/1997 Potdevin et al. ..... 439/76.1
5,752,857 A * 5/1998 Knights ..... 439/638
5,954,521 A * 9/1999 Yang ..... 439/59
6,149,450 A * 11/2000 Gastineau ..... 439/325
6,227,867 B1 * 5/2001 Chen et al. ..... 439/60
6,733,329 B1 * 5/2004 Yang ..... 439/518

* cited by examiner

*Primary Examiner*—Truc Nguyen
(74) *Attorney, Agent, or Firm*—Blakely, Sokoloff, Taylor & Zafman LLP

(57) ABSTRACT

High-reliability edge connector adaptor to support high bandwidth signal paths. The edge connector adapter includes an edge connector slot for mating with a card edge connector and a connector edge along which a set or sets of biased contacts are arrayed. The connector edge and biased contacts are configured to mate with a corresponding connector having an edge connector slot normally employed for coupling to a conventional card edge connector. In one embodiment, the edge connector slot in the adapter is configured to mate with the edge connector of an Advance Mezzanine Card (AdvancedMC) card, while the connector edge and biased contacts are configured to mate with an AdvancedMC connector. Upon assembly, the biased contacts are deflected so as to exert a normal force against a mating contact in the AdvancedMC connector. Meanwhile, the contacts of the AdvancedMC card are securely coupled to a mating contact in the edge connector adapter, e.g., using a solder or the like.

20 Claims, 9 Drawing Sheets

*Fig. 5a*
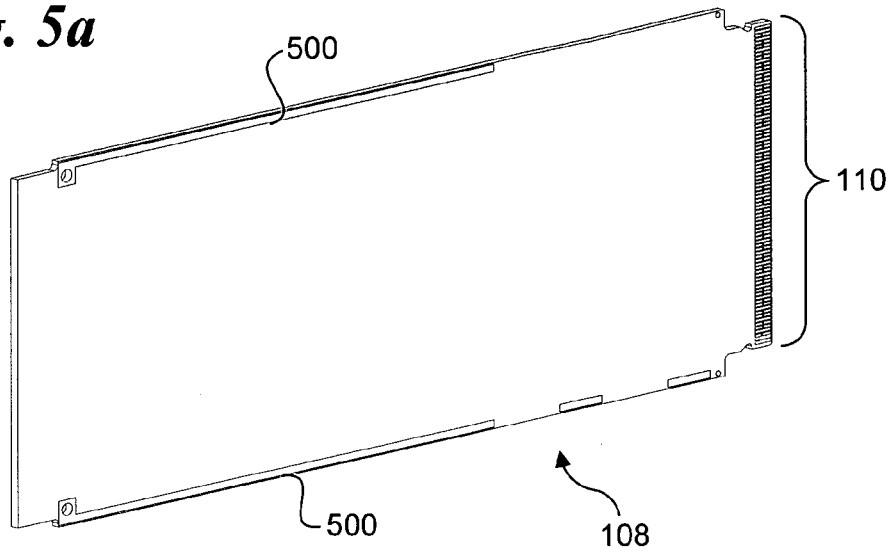
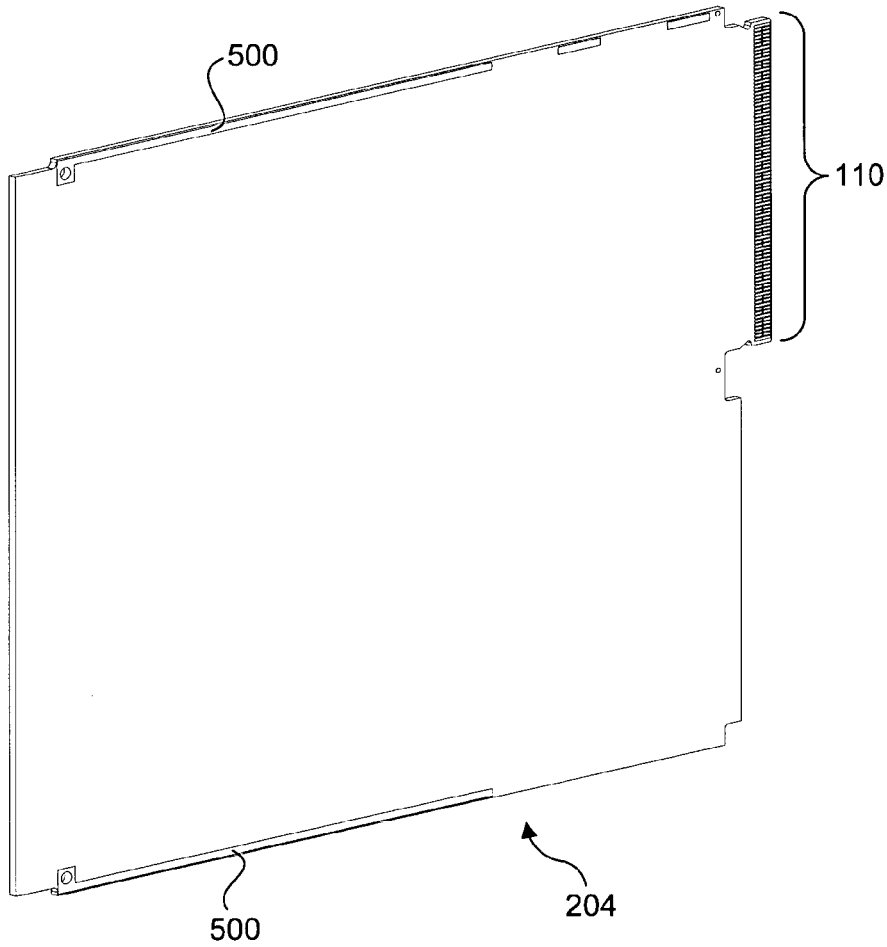
*Fig. 5b*

ELECTRICAL EDGE CONNECTOR ADAPTOR

FIELD OF THE INVENTION

The field of invention relates generally to computer and telecommunications equipment, and, more specifically but not exclusively relates to a connector and associated card edge adapter suitable for use in high-bandwidth applications such as that required for next-generation modular computer and telecommunication equipment.

BACKGROUND INFORMATION

The Advanced Telecom Computing Architecture (ATCA) (also referred to as AdvancedTCA) standard defines an open switch fabric based platform delivering an industry standard high performance, fault tolerant, and scalable solution for next generation telecommunications and data center equipment. The development of the ATCA standard is being carried out within the PCI Industrial Computer Manufacturers Group (PICMG). The ATCA Base Specification, PIGMG 3.0 Revision 1.0, published Dec. 30, 2002 (hereinafter referred to as "the ATCA specification") defines the physical and electrical characteristics of an off-the-shelf, modular chassis based on switch fabric connections between hot-swappable blades. The Advanced TCA base specification supports multiple fabric connections, and multi-protocol support (i.e., Ethernet, Fibre Channel, InfiniBand, StarFabic, PCI Express, and RapidIO) including the Advanced Switching (AS) technology.

The ATCA specification defines the frame (rack) and shelf (chassis) form factors, core backplane fabric connectivity, power, cooling, management interfaces, and the electromechanical specification of the ATCA-compliant boards. The electromechanical specification is based on the existing IEC60297 EuroCard form factor, and enables equipment from different vendors to be incorporated in a modular fashion and be guaranteed to operate. The ATCA specification also defines a power budget of 200 Watts (W) per board, enabling high performance servers with multi-processor architectures and multi gigabytes of on-board memory.

Recently, the modularity of the ATCA architecture has been extended to another level, wherein hot-swappable, field-replaceable mezzanine cards (or modules) may be hosted by an ATCA carrier board. Standards for the mezzanine cards/modules and related interfaces are defined by the Advanced Mezzanine Card (AdvancedMC) (also called AMC) specification, PIGMG AMC.0, Revision 1.0, published Jan. 3, 2005 (hereinafter referred to as the AMC.0 specification). Optimized for packet-based, high-availability telecom systems, AdvancedMC modules can be attached to a variety of ATCA and proprietary carrier blades. AdvancedMC modules communicate with the carrier board via a packet-based serial interface, which features up to 21 lanes of high-speed input/output (I/O) at 12.5 Gbit/sec each. The specification defines standard mezzanine module configuration for both full-height and half-height AdvancedMC modules, as well as modules employing single-width and double-width cards. AdvancedMC is slated to support a variety of protocols, including Ethernet, PCI Express, and Serial Rapid I/O. AdvancedMC also features integrated $I^2C$- and Ethernet-based system management. AdvancedMC modules may also be employed for non-ATCA systems.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein like reference numerals refer to like parts throughout the various views unless otherwise specified:

FIG. 5*a* is an isometric view of a single-width printed circuit board (PCB) card used in a half-height or full-height single-width AdvancedMC module;

FIG. 5*b* is an isometric view of a double-width PCB card having a single edge connector used in a conventional half-height or full-height double-width AdvancedMC module;

FIGS. 8*a–c* are cross-section views of various edge connector adaptor configuration, wherein FIG. 8*a* illustrates an edge connector adaptor that connects an AdvancedMC module card having a conventional thickness, FIG. 8*b* illustrates an edge connector adaptor that connects an AdvancedMC module card having a thickness less than the conventional, and FIG. 8*c* illustrates an edge connector adaptor that connects an AdvancedMC module card having a thickness greater than the conventional.

DETAILED DESCRIPTION

Embodiments of an edge connector adapter suitable for use in high-bandwidth applications are described herein. In the following description, numerous specific details are set forth, such as implementations for Advanced Mezzanine Card (AdvancedMC) cards and Advanced Telecommunication Architecture (ATCA) carrier boards and chassis, to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
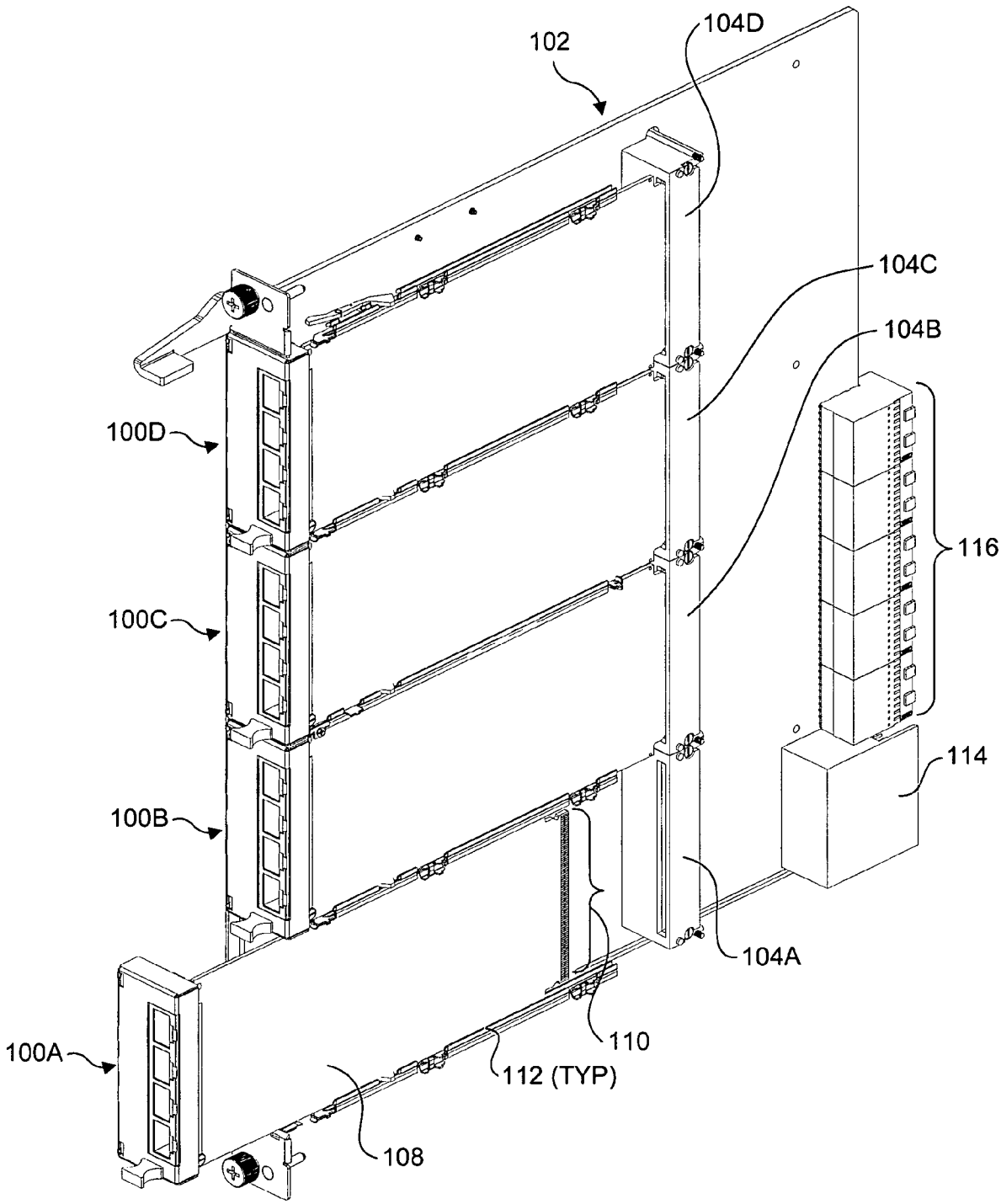
FIG. 1 is an isometric view of an Advanced Telecommunication Architecture (ATCA) carrier board to which four full-height single-width Advance Mezzanine Card (AdvancedMC) modules are coupled.

FIG. 1 shows an exemplary AdvancedMC module implementation wherein four single-width full-height AdvancedMC modules 100A, 100B, 100C, and 100D are installed on an ATCA carrier board 102. In general, ATCA carrier boards may have various configurations, depending on the number and type of AdvancedMC modules the carrier board is designed to host. For example, ATCA carrier board 102 includes four single-width full-height AdvancedMC connectors 104A, 104B, 104C, and 104D.

Under the AMC.0 specification, full-height AdvancedMC connectors are referred to as Style "B" (basic) or "B+" (extended) connectors. The term "basic" is associated with AdvancedMC connectors that are equipped with contacts on only one side of the connector slot. The term "+" identifies the connector as an extended connector having contacts on both sides of the connector slot. A single-width AdvancedMC module includes a single-width AdvancedMC card 108 having a single-width edge connector 110, further details of which are shown in FIG. 5*a*. As with its mating connector, a single-width edge connector may include contacts on a single side (basic) or both sides (extended).

The horizontal (or longitudinal) card edges of an AdvancedMC card are guided via a set of guide rails 112 disposed on opposing sides of the card. An ATCA carrier board also includes a power connector 114 via which power is provided to the carrier board from an ATCA chassis backplane, and various input/output (I/O) connectors 116 via which signals are routed to the backplane, and hence to other ATCA boards and/or AdvancedMC modules (mounted to other ATCA carrier boards) that are similarly coupled to the ATCA backplane.

Generally, the circuit components on an AdvancedMC module PCB card will be disposed on the side of the card facing the top or front side of the corresponding carrier board. This protects the circuitry, among other reasons for the configuration. To add further protection, an ATCA carrier board assembly will typically include a cover plate that is disposed over the backside of the AdvancedMC module PCB cards; the ATCA carrier board assemblies of FIGS. 1, 2, and 3, do not show the cover plate for clarity in illustrating how the PCB card edge connectors are mated to corresponding AdvancedMC connectors under a conventional implementation.

Figure 2:
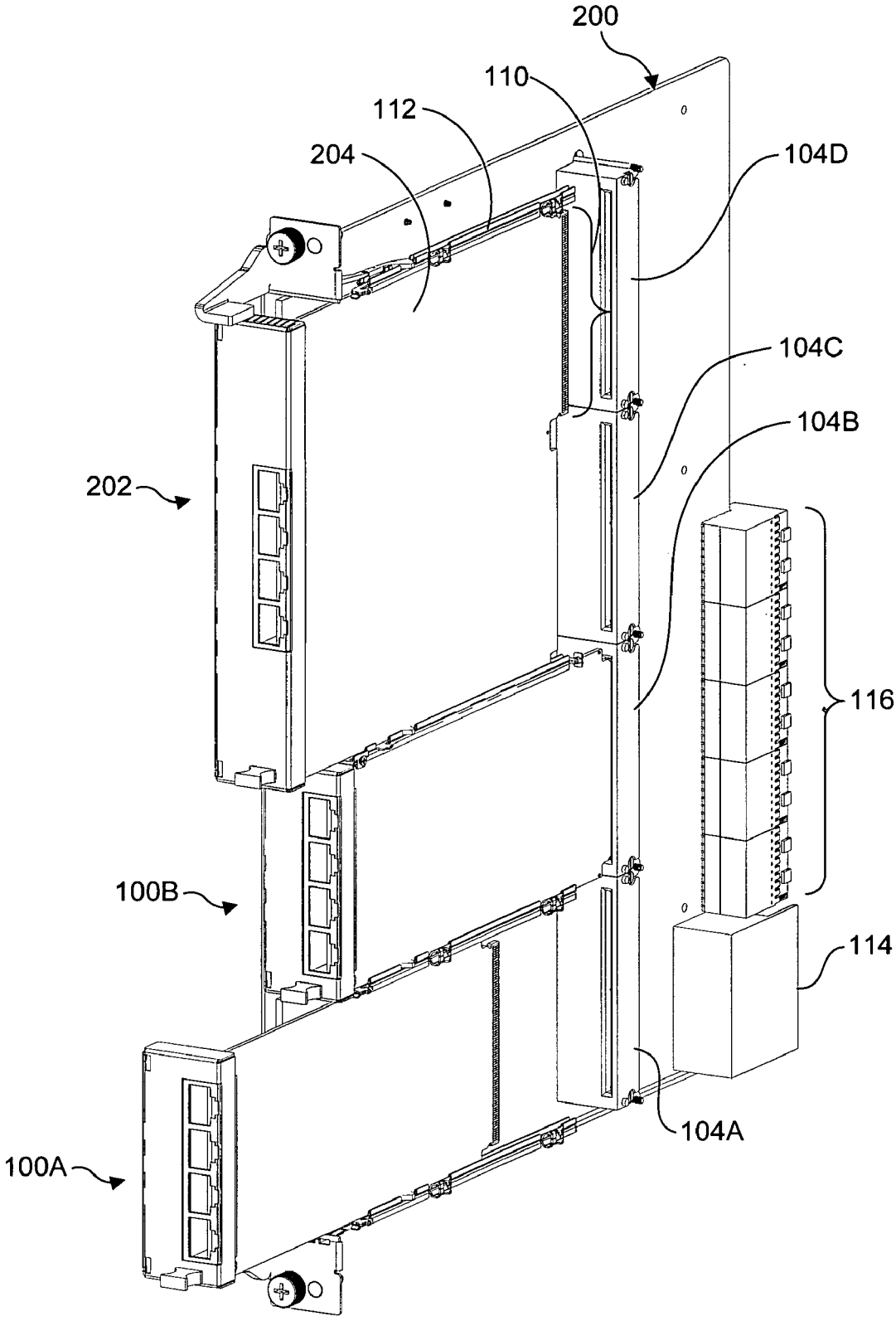
FIG. 2 is an isometric view of an ATCA carrier board to which to full-height single-width AdvancedMC modules and one conventional full-height double-width AdvancedMC module are coupled.

An ATCA carrier board 200 that supports a combination of single-width and double-width full-height AdvancedMC modules is shown in FIG. 2. As with the configuration of FIG. 1, ATCA carrier board 200 includes four full-height AdvancedMC connectors 104A, 104B, 104C, and 104D. Guide rails 112 are configured for receiving a pair of single-width full-height AdvancedMC modules 100A and 100B, as well as a double-width full-height AdvancedMC module 202. A double-width full-height module includes a double-width PCB card 204 including a single edge connector 110, as shown in FIG. 5*b*. Thus, when a conventional double-width full-height AdvancedMC module is installed, it is coupled to a single single-width full-height AdvancedMC connector 104.

Figure 3:
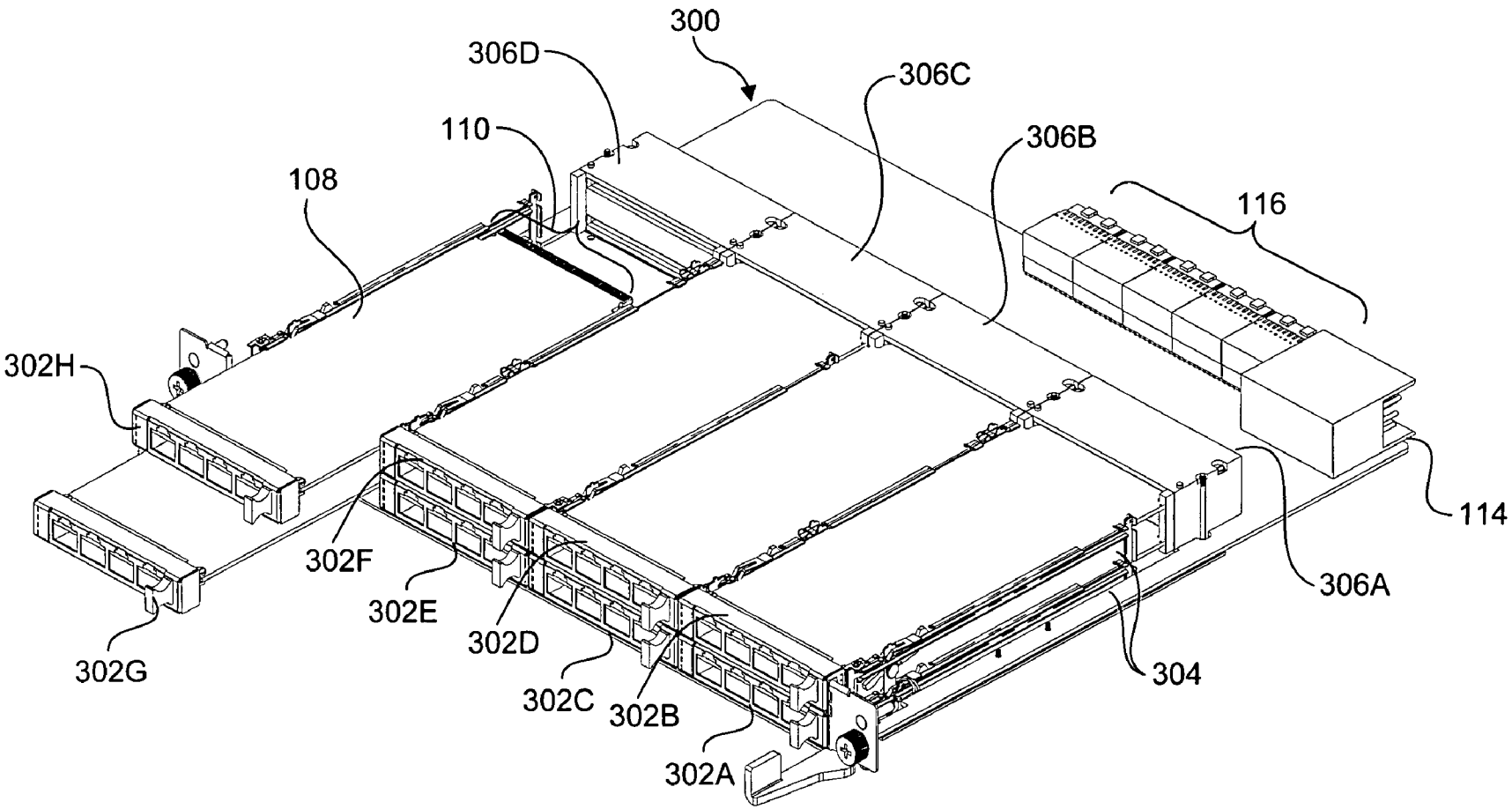
FIG. 3 is an isometric view of an ATCA carrier board to which to eight half-height single-width AdvancedMC modules are coupled.

In addition to full-height AdvancedMC modules, the AMC.0 specification defines use of single- and double-width half-height modules that may be stacked in a pair-wise manner that supports up to eight single-width, half-height modules. For example, such a configuration is shown in FIG. 3, which includes an ATCA carrier board 300 configured to support eight single-width single height AdvancedMC modules 302A, 302B, 302C, 302D, 302E, 302F, 302G, 302H. The configuration of a single-width board is the same whether it is used in a half-height or full-height AdvancedMC module. In the case of half-height modules, sets of dual-height rails 304 are employed to guide the card edges of each module.

ATCA carrier board 300 includes four AdvancedMC connectors 306A, 306B, 306C, and 306D. Each AdvancedMC connector has one of two possible configurations, referred to as style "AB" (for single-sided connections), and style A+B+ (for double sided connections). The lower connector slot on a AdvancedMC connector is referred to as slot "A", while the upper connector slot is referred to as slot "B," hence the names "AB" and "A+B+."

Figure 4:
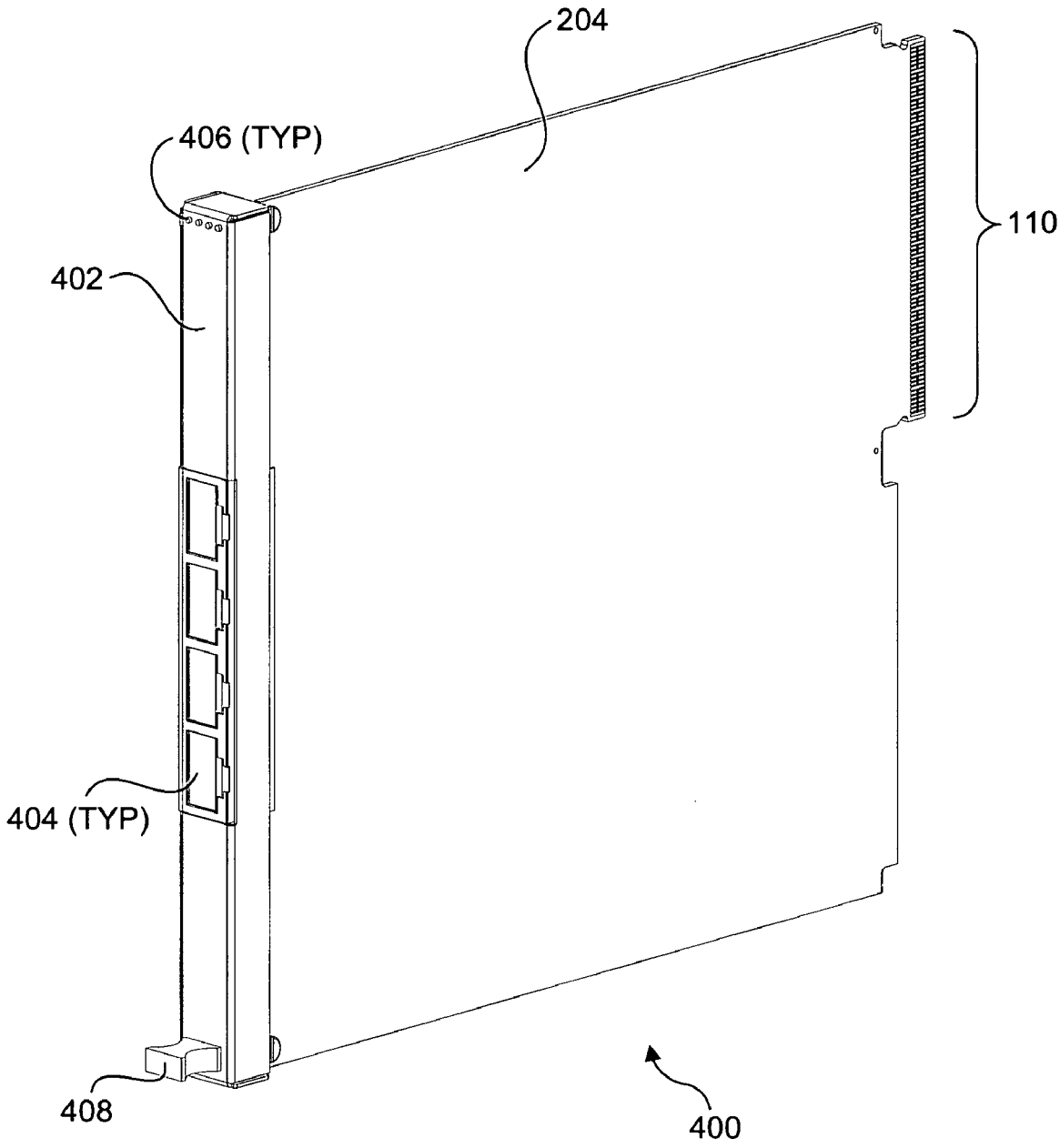
FIG. 4 is an isometric view of a conventional half-height double-width AdvancedMC module.

An example of a conventional half-height double-width AdvancedMC module 400 is shown in FIG. 4. The module includes a double-width PCB board 204 with a single edge connector 110; as with single-width modules, the configuration of a double-width PCB card is the same whether it is used in a half-height or full-height AdvancedMC module. The module 400 further includes a half-height front panel 402 (also referred to as a "face plate") coupled to PCB card 204. The front panel may generally include provisions for various input/output (I/O) ports via which external devices may communicate with a module. For illustrative purposes, FIG. 4 shows four RJ-45 Ethernet jacks 404. Various other types of I/O ports may also be employed, including, but not limited to universal serial bus (USB) ports, serial ports, infared ports, and IEEE 1394 ports. (It is noted that mechanical interface for each port is typically coupled to the PCB card, with an appropriately-sized aperture defined in the front panel). A front panel may also include various indicators, such as light-emitting diodes (LEDs) 406, for example, as well as input switches (not shown). In addition, a front panel will typically include a handle or similar means for grasping a module when it is being installed or removed from a carrier board, such as depicted by a handle 408.

Further details of an AdvancedMC module single-width PCB card 108 are shown in FIG. 5*a*, while further details of an AdvancedMC module double-width PCB card 204 are shown in FIG. 5*b*. Each of PCB cards 108 and 204 include a pair of PCB electrostatic discharge strips 500 that are used to slidingly engage AdvancedMC guide rails 112 during insertion of the associated AdvancedMC module. In addition, each of single-width PCB card 108 and conventional double-width PCB card 204 include a respective edge connector 110 of identical configuration. The single-edge connector is configured to mate with a connector slot in an appropriately configured AdvancedMC connector, wherein the conductive traces at the edge of the PCB edge-connector (also referred to as contacts) act as male pins, which mate to a corresponding contacts (in the form of tiny balls that make contact to the traces on the AdvancedMC module edge connector) in the AdvancedMC connector slot. For example, a single-sided edge connector would require a B or AB style AdvancedMC connector. Similarly, a double-sided edge connector requires a B+ or A+B+ style AdvancedMC connector.

Figure 6:
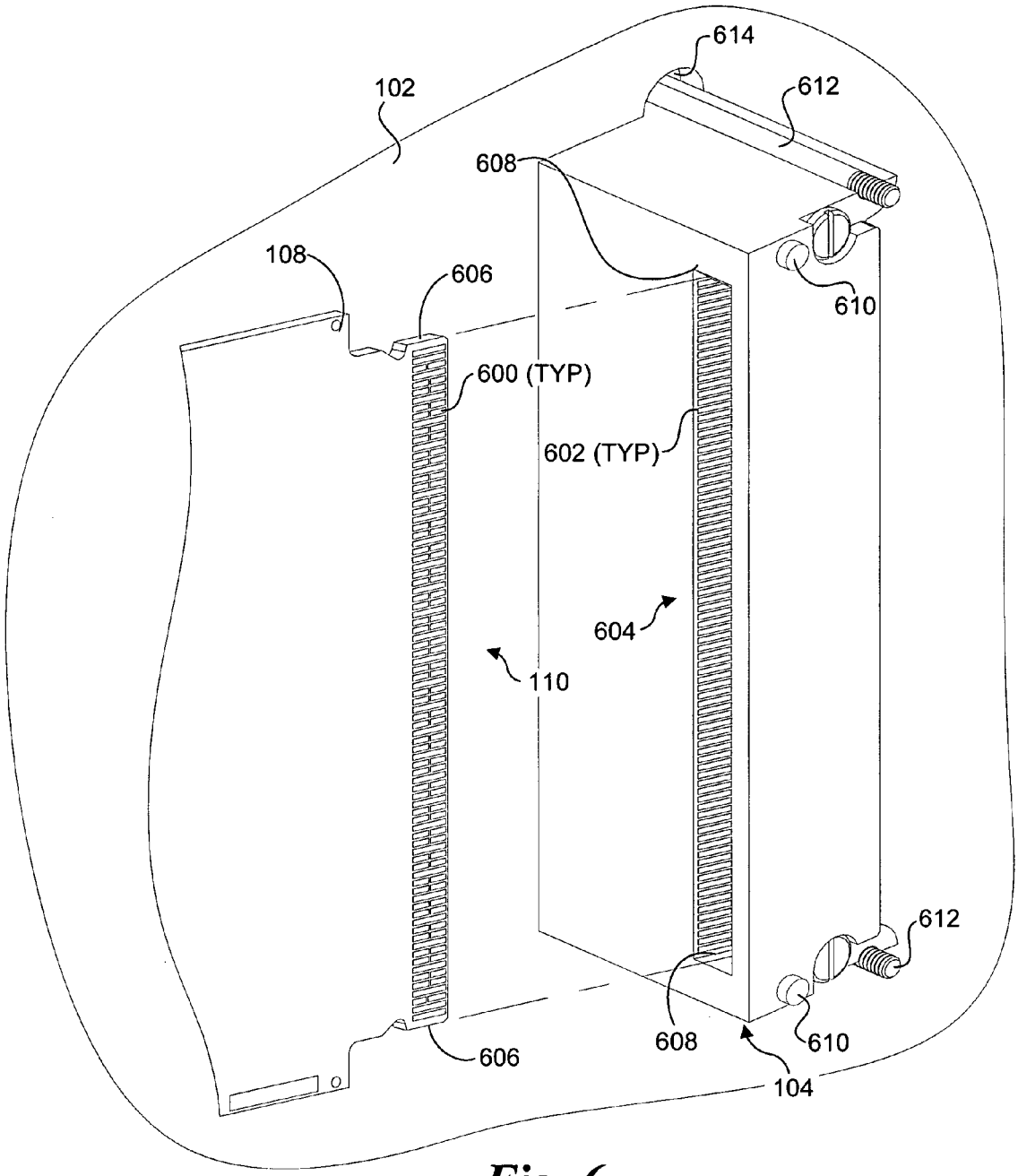
Fig. 6 (Prior Art)
FIG. 6 is a detailed isometric view of the coupling and self-centering action between an edge connector and an AdvancedMC connector.

Details of an AdvancedMC module PCB board edge connector 110 and full-height AdvancedMC connector 104 are shown in FIG. 6. A single-sided edge connector includes 85 contacts 600, while a double-side edge connector includes 170 contacts 600 (85 on both sides). The pitch of the contacts is 0.75 millimeters mm. In order to accurately align the male edge connector contacts 600 with the corresponding female AdvancedMC connector contacts 602, a self-centering scheme is employed, such that the edge connector becomes centered within the AdvancedMC connector slot 604 upon insertion of an AdvancedMC module. This is accomplished via a sliding engagement between edges 606 of edge connector 110 with mating edges 608 formed on the inside of the connector slot 606 of full-height AdvancedMC connector 104. The tolerance between the mating parts is very tight to ensure high accuracy in the alignment of the mating electric contacts. Such high accuracy is required, in part, due to the high-frequency of the numerous I/O signals coupled via an AdvancedMC connector in view of the very small contact size and contact pitch.

As in nearly all telecom applications, high availability is of prime concern. The edge card style of the AdvancedMC connector presents a reliability concern to various telecom equipment manufactures. The AMC.0 specification proscribes support for numerous duplex lanes of high-speed signals in a relatively narrow board configuration, necessitating the use of a very-tight contact pitch. More particularly, the specified signal integrity needs to accommodate 21 duplex lanes that can support a bandwidth of 12.5 Gb/s on each lane. Although the AdvancedMC connector is specified to meet telecom equipment manufacturers connector requirements defined by GR-1217-Core (connector reliability performance level 3 and system quality requirement III and quality level III), the telecom equipment manufacturers are still concerned that the specified capabilities are in fact achievable with an edge card connector design.

One embodiment addresses the foregoing concerns by providing a more resilient contact surface and adding more contact pressure than is normally achievable by conventional edge connector designs. At the same time, the embodiment supports the use of both existing a future AdvancedMC module boards (that are compliant with the AMC.0 specification) and AdvancedMC connectors.

Details of an edge connector adaptor 700 in accordance with one embodiment of the invention are shown in FIGS. 7*a*, 7*b*, and 8*a–c*. The edge connector adaptor 700 facilitates a reliable connection between a conventional AdvancedMC module card 108 with an AdvancedMC connector 104, which is depicted as being mounted to a cut-away ATCA baseboard 102 for illustrative purposes.

Figure 7A:
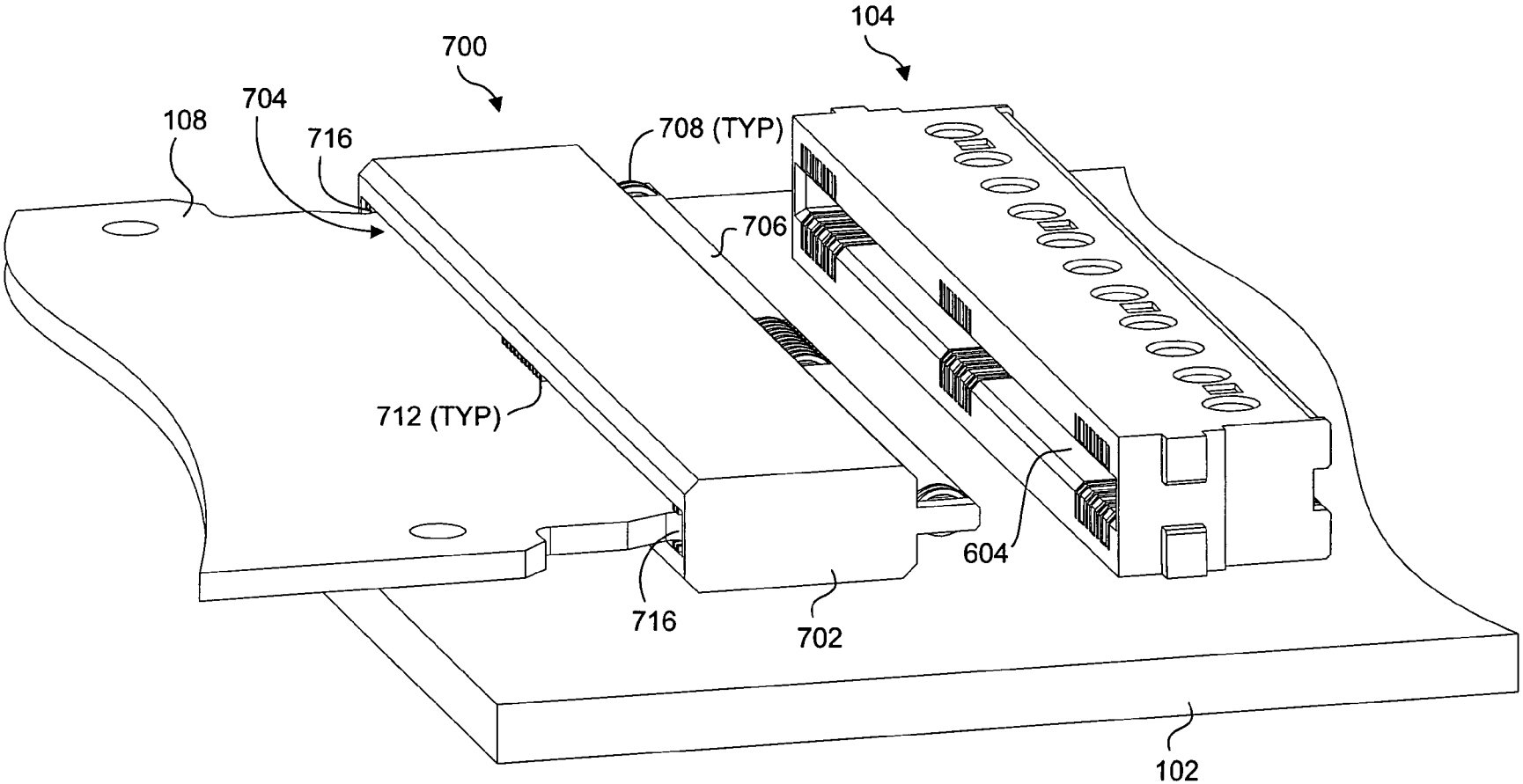
FIG. 7*a* shows an isometric view of an edge connector adaptor that reliably connects an AdvancedMC module card having a conventional edge connector with an AdvancedMC connector, according to one embodiment of the invention.
Figure 7B:
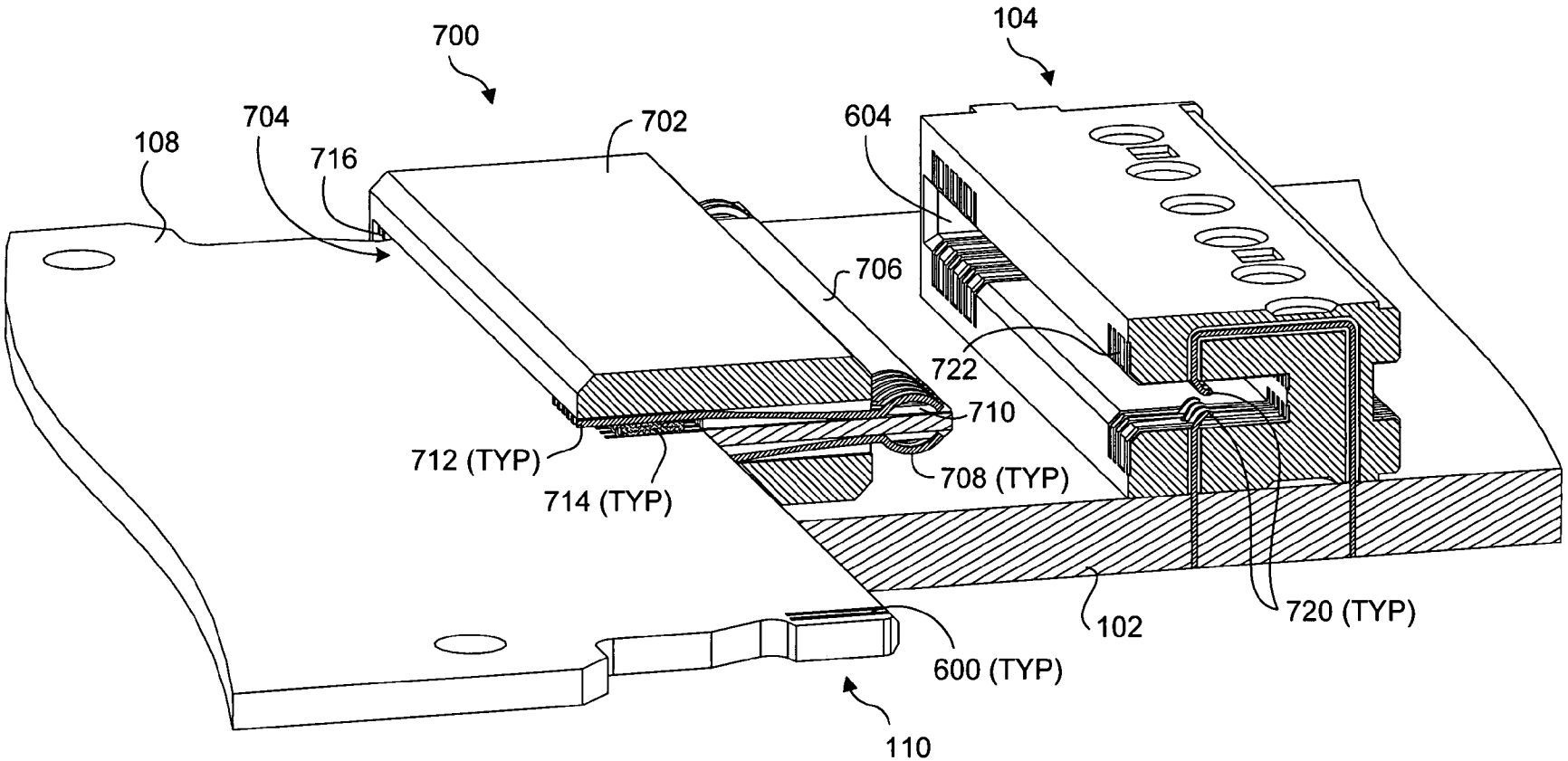
FIG. 7*b* shows a cut-away isometric view of the edge connector adaptor of FIG. 7*b*, illustrating further details of the interface between the edge connector adaptor and an AdvancedMC module card and an AdvancedMC connector.

As shown in detail in the partial isometric cut-away view of FIG. 7*b*, the edge connector adaptor 700 comprises a connector housing 702 having a edge connector slot 704 formed in one side, and a connector edge 706 extending outward from the opposing side. A plurality of biased contact members 708 (also referred to as "resilient contact fingers") are arrayed across the width of connector edge 706. For clarity, only a portion of the biased contact members are shown—however, it will be understood that in an actual implementation the biased contact members would span the width (substantially) of the connector edge.

In the illustrated embodiment, the front portion of each biased contact member has an arcuate portion configuration shaped in the form of a leaf spring. Furthermore, a respective slot 710 is formed in connector edge 706 for each biased contact member 708, while the tailing cantilevered portion of each biased contact member is encapsulated in connector housing 702. Thus, when a normal (e.g., perpendicular to the surfaces of connector edge 706) pressure is applied to a biased contact member, the leading edge of the member is free to move, assisting in enabling the arcuate portion of the member to flex. Slots 710 also serve the purpose of keeping the biased contact members 708 aligned by reducing lateral movement.

A plurality of female contacts 712 are formed on the inside of one or both inner surfaces of edge connector slot 704. For example, in one embodiment edge connector adaptor 700 provides a reliable interface between an AdvancedMC module card having contacts on a single side of the edge connector, while in another embodiment the edge connector adaptor provides an interface to an AdvancedMC module card having contacts on both sides of edge connector 110. In general, a connection means may be provided to electrically couple each female contact 712 with its respective biased contact member 708. For instance, the connection means may comprise a wire or other form of a conductor that is coupled between a female contact 712 and a biased contact member 708. However, in the illustrated embodiment, a single piece of a suitable conductor (e.g., copper with gold plating) is employed for all three functions.

In one embodiment, one purpose of the edge connector adaptor is to enhance connection reliability for the various signal lines. Accordingly, a highly-reliable electrical connection is formed between each contact 600 on edge connector 110 and a mating female contact 712. In one embodiment, this comprises a solder connection, as depicted by solder 714. Typically, a layer of solder may be applied to either or both of female contacts 712 and edge connector contacts 600. Heat is then applied to cause the solder to reflow (e.g., using a reflow oven), while the edge connector 110 for AdvancedMC module card 108 is inserted into connector housing 702. Upon cooling, a solid metallic connection is formed between each edge connector contact 600 and its corresponding female contact 712. In general, the solder may comprise a lead-based solder or a lead-free solder, depending on the requirements for a particular implementation.

In addition to the foregoing solder scheme, other types of electrical connections may also be employed, such as using a conductive epoxy or the like. In another embodiment, a pressure fit is used. In yet another embodiment, the elements of edge connector adaptor 702 and AdvancedMC module card 108 are formed as a single integral component.

To further facilitate the reliable connection between AdvancedMC module card 108 and edge connector adaptor 702, respective shoulders 716 are defined in edge connector slot 704. The shoulders are similar to shoulders 608 shown in FIG. 6, and are used to facilitate self-alignment of edge connector 110 within edge connector slot 704.

The configuration of the leading edge components of edge connector adaptor 702 supports reliable connection with mating components on AdvancedMC connector 104. To support alignment, AdvancedMC connector 104 includes a slot 604 having shoulders 608 to self-align an edge connector inserted into the slots. Accordingly, connector edge 706 is configured in the same manner as the edge connector for a conventional AdvancedMC module card. Furthermore, the spacing of biased contact members 708 matches the 0.75 mm pitch defined for AdvancedMC connector 104.

AdvancedMC connector 104 includes a plurality of connector tangs 720 (also referred to a contact beams). The configuration of the connector tang is such that when a conventional AdvancedMC module card edge connector is inserted into the AdvancedMC connector's slot, the connector tangs 720 are caused to deflect, causing each of the tangs to engage a respective edge connector contact 600. The quality and cleanliness (also known as passivation) of the plating of the circuit board contact traces is directly related to the resilience of the contact surface. The normal force between the connector tang and the contact trace determines whether a layer of residue (due to, e.g., out-gassing of other components) can eventually build up a layer of resistive material between the connector tang and the contact trace.

To enhance reliability in the connection for each signal line, each biased contact member 708 is configured to apply an additional normal force against a respective connector tang 720 upon insertion of connector edge 706 into slot 604. This causes both the biased contact member and its mating connector tang to deflect, creating a forceable engagement between the two with an increased normal force. This increased normal force leads to enhanced reliability of the connection.

To further facilitate the action of the mating components, AdvancedMC connector 104 includes a respective slot 722 for each connector tang 720. Thus, as connector edge 706 is slid into AdvancedMC connector slot 604, each biased contact member 708 engages the sides of a respective slot 722. Upon full insertion, portions of the biased contact members and connector tangs are captured within a respective slot 722, thus reducing lateral deflection of the mating biased contact member and connector tang.

Figure 8A:
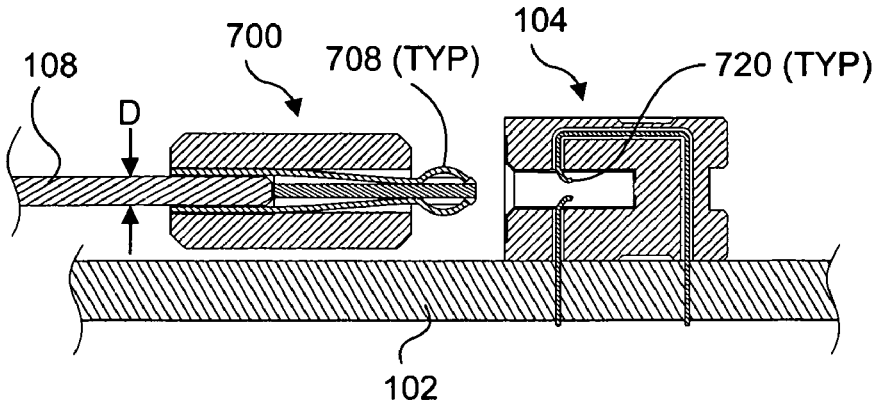
Figure 8B:
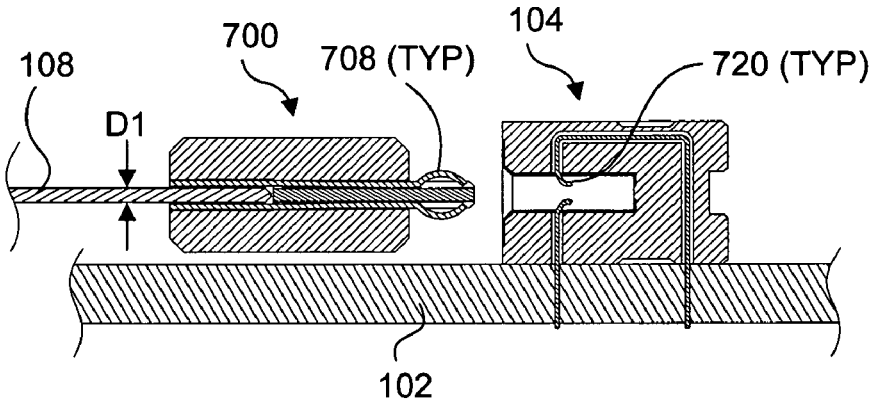
Figure 8C:
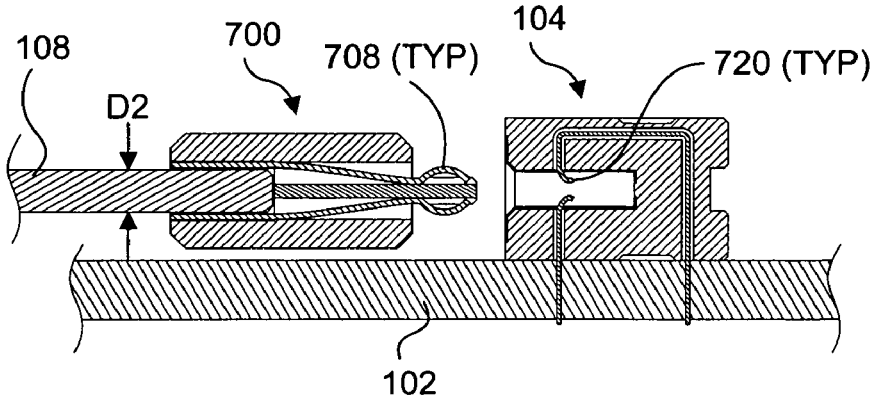

Another aspect featured by some embodiments is the ability to mate an AdvancedMC module card having a non-standard thickness with an AdvancedMC connector configured to mate with a edge connector having a standard thickness. For example, such a feature is illustrated in FIGS. 8*a–c*. FIG. 8*a* shows an AdvancedMC module card 108 having a conventional thickness D. FIG. 8*b* shows an AdvancedMC module card 108A having a thickness D1 that is less than conventional thickness D. Meanwhile, FIG. 8*c* shows an AdvancedMC module card 108B having a thickness D2 that is greater than conventional thickness D.

In general, the edge connector adaptor embodiments described herein may be manufactured employing common techniques employed in the manufacture of highly reliable connectors. Typically, the connector housing (e.g., connector housing 702) will be formed from a plastic or other type of insulator. Meanwhile, the contact members will be formed from some type of resilient conductor, such as, but not limited to copper, aluminum, beryllium, and various allows. Furthermore, the contact members may be plated with a highly-conductive plating, such as gold or silver. A casting and/or injection molding process may typically be used to manufacture the edge connector adaptor, although other techniques for forming components of this type may also be employed. In addition, post molding machine operations, such a stamping, milling, etc., may be used to form the final configuration.

In the context of the ATCA AdvancedMC module configuration a FIGS. 1–4, an edge connector adaptor in accordance with the teachings herein may be employed to couple the module card edge connector to a mating slot in an AdvancedMC connector of various types, including an B or AB style AdvancedMC connector for a single-sided edge connector, or a B+ or A+B+ style AdvancedMC connector for a double-sided edge connector. The edge connector adaptor may also be employed for the single-wide board shown in FIG. 5*a* and the dual-wide board shown in FIG. 5*b*.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the drawings. Rather, the scope of the invention is to be determined entirely by the following claims, which are to be construed in accordance with established doctrines of claim interpretation.

What is claimed is:

1. An apparatus comprising:

a housing;

an edge connector slot formed in a first side of the housing, having a plurality of female contact members disposed therein and configured to receive a circuit board edge connector having a plurality of contacts on at least one surface thereof, each female contact member disposed opposite a respective edge connector contact when the circuit board edge connector is inserted into the edge connector slot; and a connector edge extending from a side of the housing opposite the edge connector slot and having a plurality of biased contact members disposed on at least one side thereof, each biased contact member including a biased portion extending from the at least one side of the connector edge and electrically coupled to a respective female contact member.

2. The apparatus of claim 1, further comprising:

a plurality of portions of solder formed over respective female contact members, wherein the portions of solder are configured such that heating of the portions of solder when a circuit board edge connector of a circuit board is inserted in the edge connector slot forms an electrical coupling between a respective edge connector contact and female contact member.

3. The apparatus of claim 1, wherein the edge connector slot includes a plurality of female contact members disposed along both a top and bottom surface, and the connector edge includes a plurality of biased contact members disposed along both a top and bottom surface.

4. The apparatus of claim 1, wherein the connector edge has a form factor configured to mate with an Advanced Mezzanine Card (AdvancedMC) connector, and wherein, upon insertion of the connector edge into the AdvancedMC connector, a respective biased contact member is in contact with a respective contact in the AdvancedMC connector.

5. The apparatus of claim 4, wherein the edge connector slot and plurality of female contact members are configured to receive a circuit board edge connector for an AdvancedMC card.

6. The apparatus of claim 5, further comprising an AdvancedMC card having an edge inserted into the edge connector slot of the connector housing, the edge connector having a plurality of contacts, each in secure electrical contact with a respective female contact member.

7. The apparatus of claim 6, wherein the secure electrical contact comprises a solder electrically coupling each edge connector contact with a respective female contact member.

8. The apparatus of claim 1, wherein the edge connector slot is configured to receive a circuit board edge connector having a first thickness, and the connector edge extending from the side opposite the edge connector slot has a second thickness different from the first thickness.

9. The apparatus of claim 1, wherein each female contact member and its respective biased contact member are formed from a single conductive member.

10. The apparatus of claim 1, wherein a leading portion of a biased contact member is configured in the form of a leaf spring.

11. The apparatus of claim 10, further comprising a plurality of slots defined in said at least one surface of the connector edge, each slot configured to receive a portion of a respective biased contact member when contact pressure is applied to that biased contact member.

12. An edge connector adaptor, comprising:

a housing;

an edge connector slot formed in a first side of the housing, configured to receive an edge connector of a circuit board having plurality of contacts;

means for electrically coupling signals from contacts on at least one side of the edge connector of the circuit board;

a connector edge extending from a second side of the housing;

a plurality of biased contact means, disposed on at least one side of the connector edge, for electrically coupling signals to mating contacts in a connector into which the connector edge is configured to be inserted; and means for electrically coupling the electrical signals from the contacts on the at least one side of the edge connector of the circuit board to the plurality of biased contact means.

13. The edge connector adaptor of claim 12, wherein the edge connector slot includes a plurality of female contact members on both a top and bottom side, and the connector edge includes a plurality of biased contact means on both a top and bottom side.

14. The edge connector adaptor of claim 12, further comprising:

means for aligning the contacts on the at least one side of the edge connector of the circuit board with the means for electrically coupling signals from those contacts.

15. The edge connector adaptor of claim 12, wherein the connector edge has a form factor configured to mate with an Advanced Mezzanine Card (AdvancedMC) connector, wherein, upon insertion of the connector edge into the AdvancedMC connector, a respective biased contact means is in contact with a respective contact means in the AdvancedMC connector.

16. An apparatus, comprising an Advanced Mezzanine Card (AdvancedMC) edge connector adaptor, including, a housing, having a edge connector slot formed in a first side and a connector edge extending outward from a second side opposite the first side; and a first set of conductive members, arrayed across a width of the housing, each conductive member having a cantilevered first end disposed in the edge connector slot and a biased contact formed towards a second end, a portion of the biased contact extending above the connector edge, wherein the edge connector slot and cantilevered first ends of the conductive members are configured to receive and electrically interface with an edge connector of an AdvancedMC card, and the connector edge and biased contacts are configured to interface with an edge connector slot of an AdvancedMC connector, each biased contact producing a force against a respective contact in the edge connector slot upon insertion of the connector edge into the edge connector slot due to deflection of a portion of that biased contact.

17. The apparatus of claim 16, wherein the AdvancedMC edge connector adapter further includes:

a second set of conductive members, arrayed across a width of the housing, each conductive member in the second set of conductive members disposed opposite a respective conductive member of the first set of conductive members, wherein the edge connector slot and cantilevered first ends of the conductive members of the first and second sets are configured to interface with an AdvancedMC card having an edge connector with contacts on two sides, and the connector edge and biased contacts are configured to interface with an edge connector slot of an AdvancedMC slot having contacts disposed in both an upper and lower surface of the edge connector slot.

18. The apparatus of claim 16, wherein the AdvancedMC edge connector adapter further includes:

a respective slot formed in the connector edge for each conductive member, the each respective slot configured to enable a portion of a biased contact for its corresponding conductive member to be deflected in a direction normal to the slot while restricting lateral movement of the biased contact.

19. The apparatus of claim 16, wherein a leading portion of each biased contact is configured in the form of a leaf spring.

20. The apparatus of claim 16, further comprising:

an AdvancedMC card having an edge connector inserted into the edge connector slot of the connector housing, the edge connector having a plurality of contacts, each soldered to a respective conductive member.

* * * * *